US006131243A

United States Patent [19]

Lee

[11] Patent Number: 6,131,243

[45] Date of Patent: Oct. 17, 2000

[54] CARRIER SLIDE FOR A COLLAPSIBLE DOORPLATE ASSEMBLY

[76] Inventor: Chen Hsiang Lee, Suit 1, No. 10, Lane 73, Chung-Chien Road, Hsiao-Kang, Kaohsiung, Taiwan

[21] Appl. No.: 09/193,423

[22] Filed: Nov. 18, 1998

[30] Foreign Application Priority Data

May 12, 1998 [TW] Taiwan ..... 87207391

[51] Int. Cl.[7] ..... E05D 15/00

[52] U.S. Cl. ..... 16/87.2

[58] Field of Search ..... 16/87.2, 93 D, 16/94 D, 96 D, 97, 106; 106/345, 330

[56] References Cited

U.S. PATENT DOCUMENTS

| | | | |
|---|---|---|---|
| 4,675,939 | 6/1987 | Fukada | 16/87.2 |
| 4,846,249 | 7/1989 | Cooper et al. | 160/345 |
| 5,282,292 | 2/1994 | Levy | 16/87.2 |
| 5,291,632 | 3/1994 | Akashi | 16/87.2 |
| 5,544,387 | 8/1996 | Yamamoto et al. | 16/87.2 |

*Primary Examiner*—Chuck Y. Mah
*Attorney, Agent, or Firm*—Bacon & Thomas PLLC

[57] ABSTRACT

A carrier slide includes a main body, a roller member, and a connecting member. The main body includes a base having a hole defined therein and a mounting member formed on the base. The mounting member includes a receiving groove defined in an underside thereof and having an opening that faces the base. The roller member includes a shaft and two wheels respectively mounted to two ends of the shaft to rotate therewith. The shaft has a diameter slightly smaller than a width of the opening of the receiving groove. The wheels rest on and are movable along a bottom of the rack. The connecting member has an upper end with a snapping fastener releasably engaged with the hole of the base and a lower end engaged with an upper end of a leaf plate of a collapsible doorplate assembly.

4 Claims, 4 Drawing Sheets

CARRIER SLIDE FOR A COLLAPSIBLE DOORPLATE ASSEMBLY

BACKGROUND OF THE INVENTION

1 Field of the Invention

The present invention relates to a carrier slide for a collapsible doorplate assembly, and more particularly for a carrier slide that can be easily, quickly attached to a rack of the collapsible doorplate assembly.

2. Description of the Related Art

FIG. 4 of the drawings illustrates a conventional collapsible doorplate assembly I that includes a number of leaf plates 11 each being connected to a rack 2 by a carrier slide 3. As shown in FIG. 5, the carrier slide 3 includes a main body 31 having a vertical groove 311 defined two walls on an upper side thereof The walls include aligned holes 312 defined therein, and each wall includes a roller 32 rotatably mounted to an outer side thereof by means of extending a pin 321 through the rollers 32 and the holes 312. The main body 31 is securely connected to an upper end of a leaf plate 11 via a U-shaped connecting member 33. A pin 331 is extended through a vertical hole 314 in a lower end of the main body 31 and a vertical hole 333 of the connecting member 33 and then riveted (see FIG. 6) at a lower end thereof A further pin 34 is extended through aligned holes 332 of two limbs of the U-shaped connecting member 33 and a hole 111 (FIG. 4) of the leaf plate 11 and then secured by a nut (not labeled).

Nevertheless, such a carrier slide 3 requires troublesome assembly procedure and the riveting procedure for the pin 331. In addition, the connecting member 33 might be disengaged if the riveting effect is poor. Furthermore, the assembly between the carrier slide 3, the leaf plates 11, and the rack 2 is inconvenient no matter what the assembly sequence is. It is therefore a long and unfulfilled need for an improved carrier slide that mitigates and/or obviates the above-mentioned problems.

SUMMARY OF THE INVENTION

It is a primary object of the present invention to provide an improved carrier slide that can be easily, quickly assembled to the rack of a collapsible doorplate assembly.

In accordance with the present invention, a carrier slide is provided for a collapsible doorplate assembly having a rack and a plurality of leaf plates. The carrier slide comprises a main body including a base having a hole defined therein and a mounting member formed on the base. The mounting member includes a receiving groove defined in an underside thereof and having an opening that faces the base. A roller member includes a shaft and two wheels respectively mounted to two ends of the shaft to rotate therewith. The shaft has a diameter slightly smaller than a width of the opening of the receiving groove. The wheels rest on and are movable along a bottom of the rack. A connecting member has an upper end with a snapping fastener releasably engaged with the hole of the base and a lower end engaged with an upper end of a leaf plate of the collapsible doorplate assembly.

By such an arrangement, the carrier slide can be easily, quickly attached to the rack.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
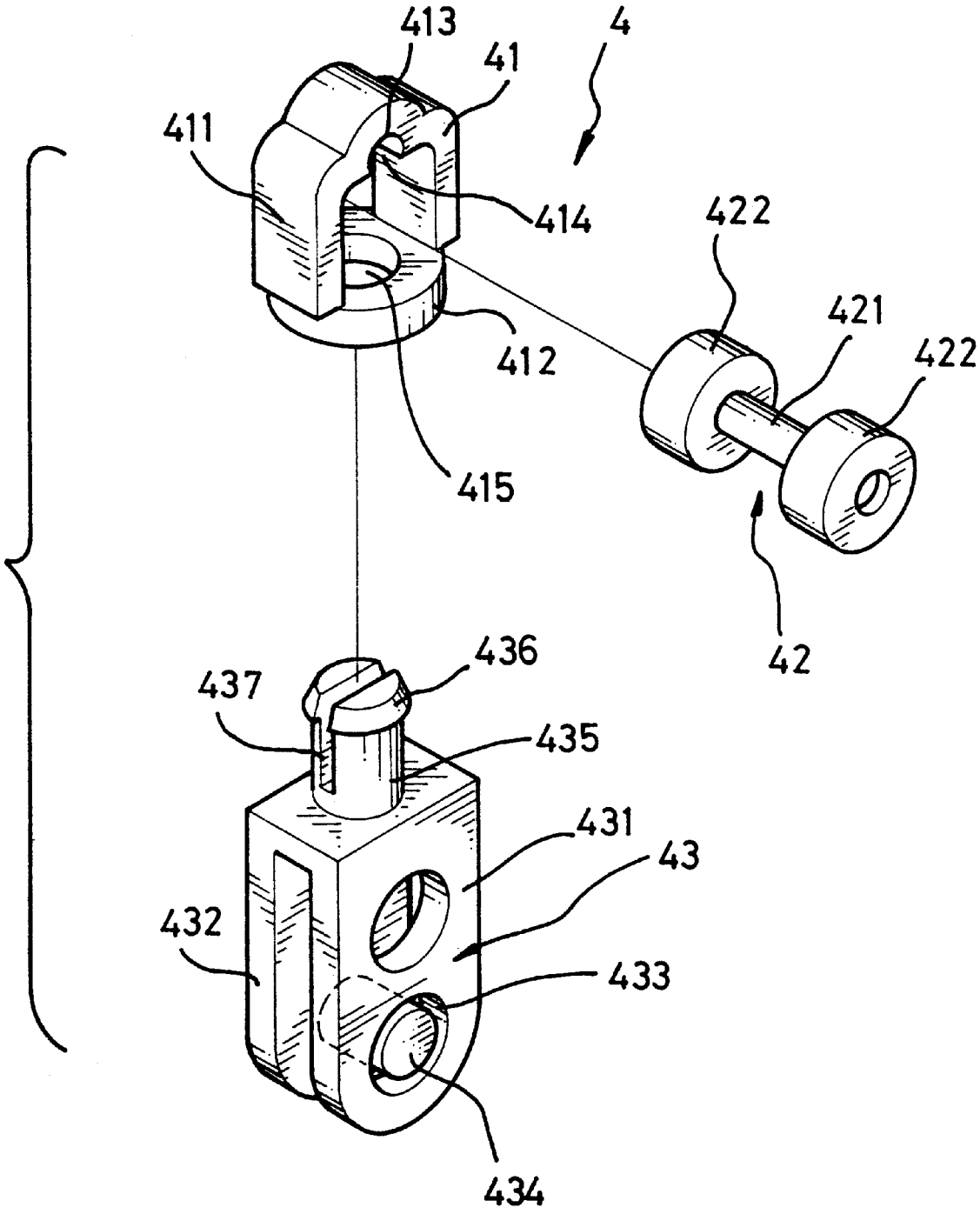
FIG. 1 is an exploded perspective view of a carrier slide in accordance with the present invention.

Referring to the FIG. 1, a carrier slide for a collapsible doorplate assembly in accordance with the present invention generally includes a main body 41, a roller member 42, and a connecting member 43. The main body 41 includes a base 412 having a vertical hole 415 and a substantially inverted U-shaped mounting member 411 formed on an upper side of the base 412. The mounting member 411 includes a receiving groove 413 defined in a mediate section thereof and having an opening 414 that faces the base 412. The roller member 42 includes a shaft 421 and two wheels 422 respectively attached to two ends of the shaft 421 to rotate therewith. The shaft 421 has a diameter slightly smaller than a width of the opening 414 of the receiving groove 413.

Figure 2:
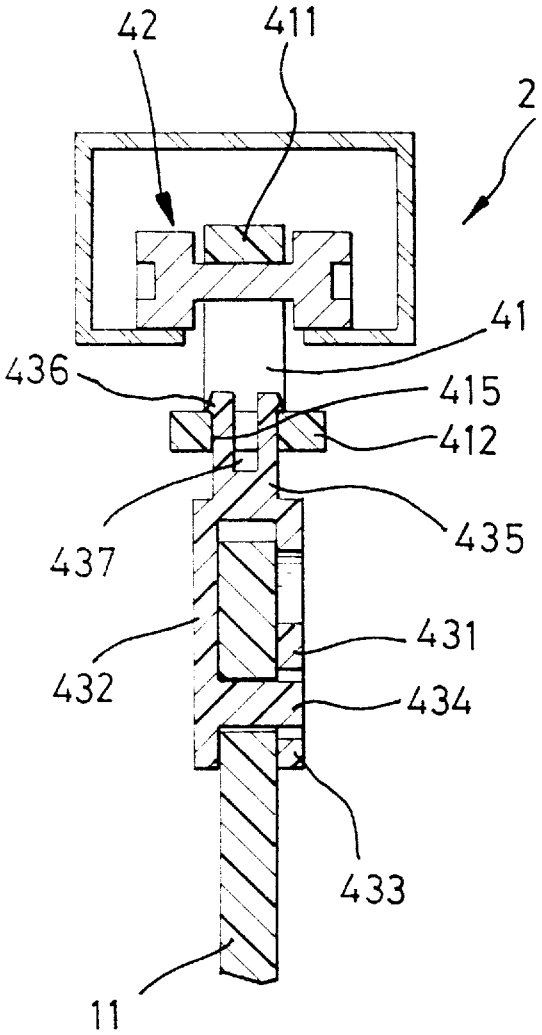
FIG. 2 is a sectional view of a rack, an upper portion of a leaf plate of a collapsible doorplate assembly, and the carrier slide in accordance with the present invention.
Figure 4:
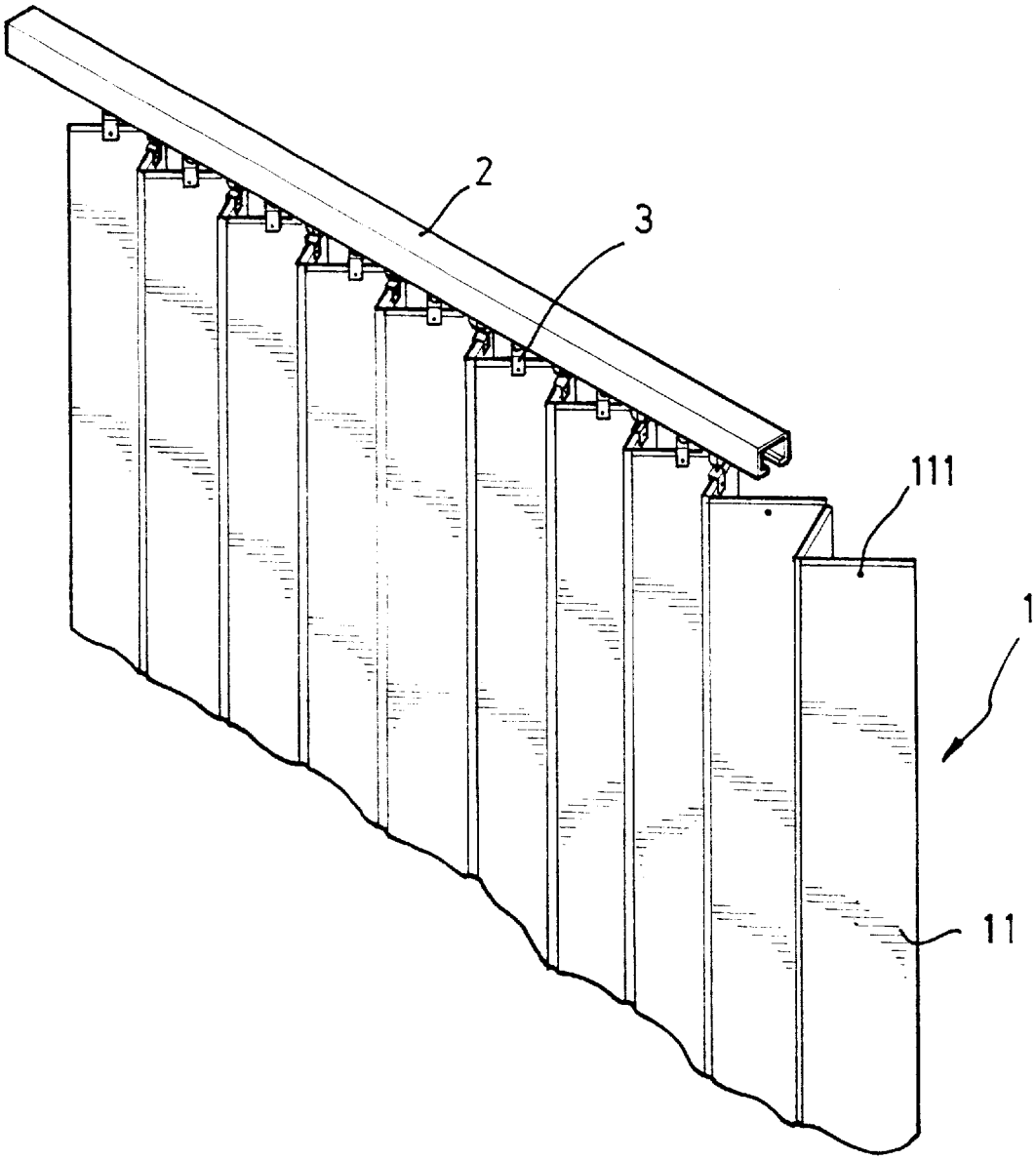
FIG. 4 PRIOR ART
FIG. 4 is a perspective view of a collapsible doorplate assembly according prior art.
Figure 5:
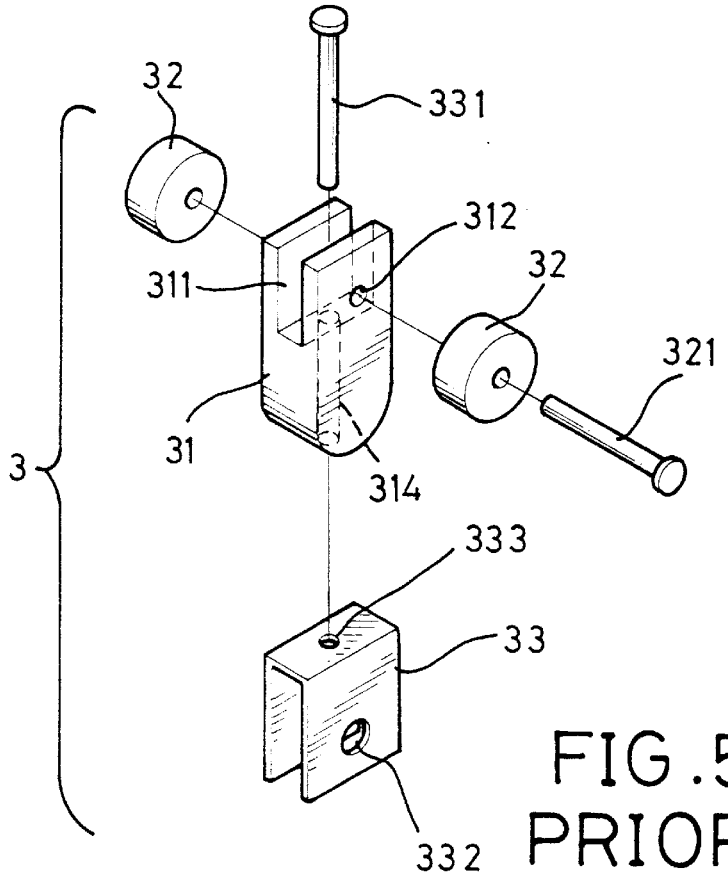
FIG.5 PRIOR ART
FIG. 5 is an exploded perspective view of a carrier slide according to prior art.
Figure 6:
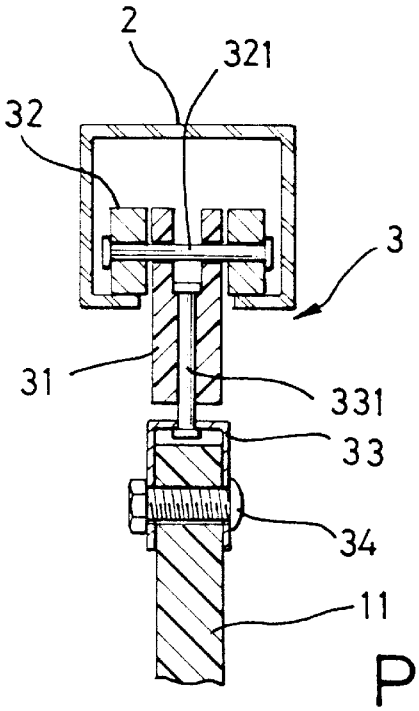
FIG.6 PRIOR ART
FIG. 6 is a sectional view of a rack, an upper portion of a leaf plate of a collapsible doorplate assembly, and the carrier slide according to prior art.

The connecting member 43 includes a lower end 431 connected to an upper portion of a leaf plate of a collapsible doorplate assembly and an upper end. The collapsible doorplate assembly may be of the type shown in FIG. 4. In this embodiment, the lower end of the connecting member 43 includes a pair of spaced walls 432 that define a compartment therein for receiving the upper portion of a leaf plate 11, best shown in FIG. 2. One of the walls 432 includes a hole 433 defined therein, while the other wall 432 includes a stub 434 projecting therefrom and extending into the hole 433. The stub 434 is extended through the hole 111 (FIG. 4) of the leaf plate 11 to secure the leaf plate 11 and the connecting member 43 together. Thus, the lower end of the connecting member 43 is secured to a leaf plate 11. Nevertheless, other connecting means can be applied to achieve the same connecting function. The upper end of the connecting member 43 includes a snapping fastener 435 formed thereon. The snapping fastener 435 includes an enlarged head 436 and a longitudinal slit 437 defined therein and separating the enlarged head 436 into two sections. The snapping head 436 is made of resilient material and has a diameter greater than that of the hole 415.

Figure 3:
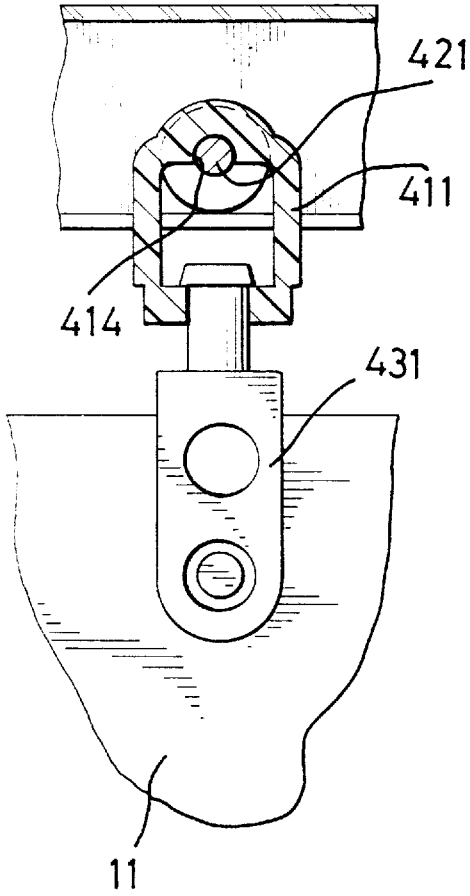
FIG. 3 is a sectional view illustrating an upper portion of the carrier slide in accordance with the present invention.

In assembly, the roller member 41 is inserted into a space defined between the base 412 and the mounting member 411. The shaft 421 of the roller member 41 is then forcibly inserted into the receiving groove 414 of the mounting member 411 and thus retained in position, as the shaft 421 has a diameter slightly smaller than a width of the opening 414 of the receiving groove 413 (see FIG. 3). It is appreciated that the wheels 422 rest on and movable along a bottom of the rack 2, best shown in FIG. 2. The upper end of the connecting member 43 is engaged with the base 412 by means of extending the snapping fastener 435 through the hole 415 of the base 412. The two sections of enlarged head 436 are moved toward each other and then passed through the hole 415. Thereafter, the two sections of the enlarged head 436 expand to their original position. Thus, the snapping head 436 is engaged with the base 411, as the diameter of the snapping head 436 is greater than that of the hole 415.

Furthermore, the main body 41 and the roller member 42 can be firstly inserted into a rack 2 of the doorplate assembly, and the leaf plate 11 can be attached to the lower end of the associated carrier slide 43. Alternatively, the lower end 431 of the carrier slide 43 can be attached to the leaf plate 11, and then, the upper end of the carrier slide 43 can be attached to the main body 41. Both assembly sequences are simple and easy to achieve.

Although the invention has been explained in relation to its preferred embodiment, it is to be understood that many other possible modifications and variations can be made without departing from the spirit and scope of the invention as hereinafter claimed.

What is claimed is:

1. A carrier slide for a collapsible doorplate assembly having a rack and a plurality of leaf plates, the carrier slide comprising:

a main body including a base having a hole defined therein and a mounting member formed on the base, an underside of the mounting member including a receiving groove with an opening that faces the base, a roller member including a shaft with two ends and two wheels respectively mounted to the two ends of the shaft to rotate therewith, the shaft having a diameter slightly smaller than a width of the opening of the receiving groove, the wheels being adapted to rest on and be movable along a bottom of the rack, and a connecting member having an upper end with a snapping fastener releasably engaged with the hole of the base and a lower end adapted to be engaged with an upper end of a leaf plate of the collapsible doorplate assembly.

2. The carrier slide recited in claim 1, wherein said connecting member is formed in one piece.

3. The carrier slide recited in claim 2, wherein said lower end of the connecting member includes two walls with a space therebetween for receiving an end of one of the leaf plates.

4. The carrier slide recited in claim 3 wherein one of said two walls includes a hole for receiving a stub which projects from the other wall and then into the hole for securing the one leaf plate to the connecting member.

* * * * *